US007260523B2

(12) United States Patent
Paksoy et al.

(10) Patent No.: US 7,260,523 B2
(45) Date of Patent: Aug. 21, 2007

(54) SUB-BAND SPEECH CODING SYSTEM

(75) Inventors: Erdal Paksoy, Richardson, TX (US); Alan V. McCree, Dallas, TX (US)

(73) Assignee: Texas Instruments Incorporated, Dallas, TX (US)

( * ) Notice: Subject to any disclaimer, the term of this patent is extended or adjusted under 35 U.S.C. 154(b) by 726 days.

(21) Appl. No.: 09/732,337

(22) Filed: Dec. 7, 2000

(65) Prior Publication Data

US 2002/0072899 A1 Jun. 13, 2002

Related U.S. Application Data

(60) Provisional application No. 60/171,393, filed on Dec. 21, 1999.

(51) Int. Cl.
*G10L 19/02* (2006.01)

(52) U.S. Cl. ..... 704/220; 704/229

(58) Field of Classification Search ..... 704/220, 704/229, 266, 205, 225, 226, 219, 230, 500
See application file for complete search history.

(56) References Cited

U.S. PATENT DOCUMENTS 5,231,669 A * 7/1993 Galand et al. ..... 704/205
5,321,793 A * 6/1994 Drogo De Iacovo et al. ..... 704/220
5,459,514 A * 10/1995 Sakamoto et al. ..... 375/240.11
5,490,130 A * 2/1996 Akagiri ..... 369/124.08
5,530,750 A * 6/1996 Akagiri ..... 704/500
5,757,931 A * 5/1998 Yamada et al. ..... 381/61
5,808,569 A * 9/1998 Wuppermann et al. ..... 341/50
5,914,752 A * 6/1999 Iwamura et al. ..... 348/427.1
5,926,791 A * 7/1999 Ogata et al. ..... 704/500
6,122,338 A * 9/2000 Yamauchi ..... 375/377
6,167,375 A * 12/2000 Miseki et al. ..... 704/229
6,182,031 B1 * 1/2001 Kidder et al. ..... 704/205
6,324,505 B1 * 11/2001 Choy et al. ..... 704/230
6,697,775 B2 * 2/2004 Kawahara ..... 704/229
6,904,404 B1 * 6/2005 Norimatsu et al. ..... 704/222
2002/0099548 A1 * 7/2002 Manjunath et al. ..... 704/266

OTHER PUBLICATIONS

Jurgen W. Paulus and Jurgen Schnitzler, "16 Kbit/s Wideband Speech Coding Based on Unequal Subbands" IEEE, pp. 255-258, 1996.
High-Frequency Regeneration of Base-Band Vocoders by Multi-Pulse Excitation; C. Galand et al.; 1987 IEEE, pp. 1934-1937.
Hi-BIN: An Alternative Approach to Wideband Speech Coding; R. Taori et al.; 2000 IEEE; pp. 1157-1160.
A 13.0 KBIT/S Wideband Speech Codec Based on SB-ACELP; J. Schnitzler; 1998 IEEE; pp. 157-160.
Multiband CELP Coding of Speech; A. Benyassine et al.; 1990 Maple Press; pp. 644-648.
T. Nomura et al. "A bitrate and bandwidth scalable celp coder", IEEE ICASSP 1998, May 12-15, 1998.

* cited by examiner

*Primary Examiner*—Daniel Abebe
(74) *Attorney, Agent, or Firm*—Carlton H. Hoel; W. James Brady; Frederick J. Telecky, Jr.

(57) ABSTRACT

An improved sub-band speech coding system is provided by subdividing signals into a lower an higher subband, down-sampling the lower subband before coding and coding the higher subband without downsampling. The decoder includes decoding and upsampling of the lower subband and decoding the higher subband and adding the higher subband to the lower subband.

20 Claims, 1 Drawing Sheet

SUB-BAND SPEECH CODING SYSTEM

This application claims priority under 35 USC § 119(e)(1) of provisional application No. 60/171,393, filed Dec. 21, 1999.

FIELD OF INVENTION

This invention relates to speech coder based on code excited linear prediction (CELP) coding and, more particularly, to a sub-band speech coder.

BACKGROUND OF INVENTION

Speech compression is a fundamental part of digital communication systems. In a traditional telephone network, the speech signal is a narrow band signal that is band limited to 4 kHz. Many of the new emerging applications do not require the speech bandwidth to be limited. Hence, wide-band signals with a signal bandwidth of 50 to 7,0000 Hz, resulting in a higher perceived quality, are rapidly becoming more attractive for new application such as voice over Internet Protocol, or third generation wireless services. Consequently, digital coding of wideband speech is becoming increasingly important.

Code-Excited Linear Prediction (CELP) is a well-known class of speech coding algorithms with good performance at low to medium bit rates (4 to 16 kb/s) for narrow band speech. See B. S. Atal and M. Schroeder's article entitled "Stochastic Coding of Speech Signals at Very Low Bit Rates," *IEEE International conference on Acoustics, Speech and Signal Processing*, May 1984. For wide band speech, the same algorithm can be used over the entire input bandwidth with some degree of success. Alternatively, the input signal can be decomposed into two or more sub-bands which are coded independently. In these sub-band coders the signal is downsampled, coded, and upsampled again. In traditional sub-band coders, the signal is critically sub-sampled. Some anti-aliasing filters with non-zero transition bands used in practical applications introduce some leakage between the bands, which causes sometimes audible aliasing distortions. Quadrature Mirror Filters (QMF) where the aliasing is cancelled out during resynthesis can be used in the case of equal sub-band decomposition. In the general case of unequal sub-band, critical subsampling introduces aliasing.

SUMMARY OF INVENTION

In accordance with one embodiment of the present invention, a wideband coder is provided wherein the bandwidth is subdivided into sub-bands which may be unequal. The lower sub-band is downsampled and encoded using a CELP coder. A higher sub-band is not downsampled, but is computed over the entire frequency range and the band-pass filtered to complement the lower band.

DESCRIPTION OF PREFERRED EMBODIMENT OF THE PRESENT INVENTION

Figure 1:
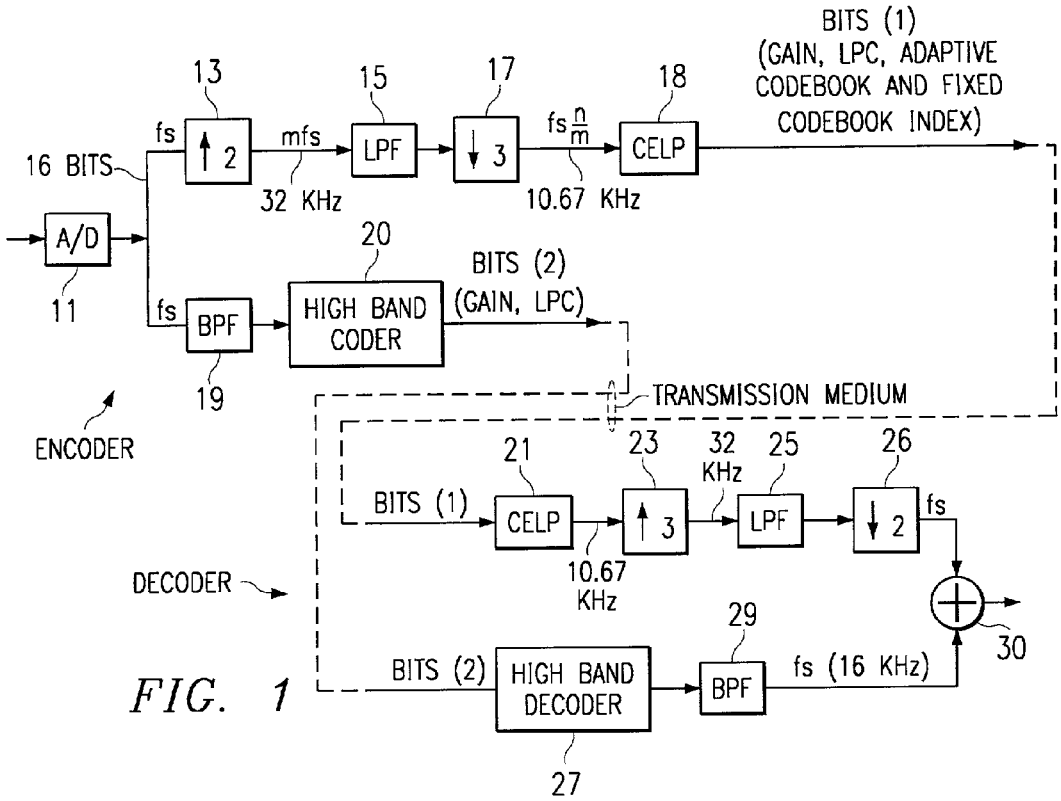
FIG. 1 is a block diagram of the coding system according to one embodiment of the present invention.

Referring to FIG. 1, there is illustrated a sub-band coder system according to one embodiment of the present invention. CELP coders operate on fixed-length segments of the input called frames. The coder comprises an encoder/decoder pair. The encoder processes each frame of speech by computing a set of parameters which it codes and transmits to a decoder. The decoder receives this information and synthesizes an approximation to the input speech, called coded speech.

The input speech is sampled at a same frequency fs (16 kHz for example) at A/D (analog to digital) converter 11 and has a signal bandwidth of fs/2 (8 kHz). For coding purposes, this bandwidth is sub-divided into two, possibly unequal, sub-bands. For example, consider a wideband speech coder operating at 16 kHz with a useful signal bandwidth of 50 to 7,000 Hz. A reasonable low-band bandwidth could be 0 to 5.33 kHz (illustrated in FIG. 2) obtained by upsampling by 2 (nfs) at upsampler 13 (32 kHz), low-pass filtering with a lowpass filter 15 with a transition band between, for example, 5 and 5.33 kHz and downsampled by 3 (nfs/3) at downsampler 17, resulting in a 10.67 kHz sampled low band signal. The downsampled (10.67 kHz) lower-band signal is encoded using a CELP coder 18. The low-band parameters from the LPC coder comprise linear prediction (LPC) coefficients, which specify a time-varying all-pole filter (LPC filter) and excitation parameters. The excitation parameters specify a time-domain waveform called the excitation signal, which comprises adaptive and fixed excitation contributions and corresponding gain factors (gain, LPC, adaptive codebook index and fixed codebook index).

The high-band signal is obtained from the original by simply band-pass or highpass filtering it before applying to a highband coder 20. An appropriate bandwidth can be between $fs_1$ and $fs_2$ such as 5.33 and 7 kHz. The 16 kHz input, for the example, is band-pass filtered between 5.33 kHz and 7 kHz to obtain the high-band signal. The transition band of this filter would have to be between 5 and 5.33 kHz and designed to complement the low-band low-pass filter. The bandpass filtered output is coded in a highband coder 20. There are several possible ways to generate the high-band excitation coder 20, such as random noise, noise excited LPC, gain-matched analysis-by-synthesis, multi-pulse coding or a combination.

The encoded signal is transmitted to the decoder via a transmission medium such as a cable or wireless network. At the decoder, the lowband excitation signal is reconstructed at the low band rate of 10.67 kHz (2fs/3) and this is applied to the CELP decoder (LPC synthesis filter) 21. The output of the CELP decoder 21 is upsampled at upsampler 23 (upsampled by 3) to 2fs (32 kHz) and low-pass filtered at filter 25 at 5.33 kHz and downsampled by downsampler 26 (downsampled at 2) to fs at 16 kHz to form the low-band coded signal. The high band signal of fs (16 kHz) is generated at highband pass decoder 27 at the original sampling rate and bandpass filtered at bandpass filter 29 to obtain the fs (16 kHz) high-band coded signal. The 16 kHz signal is bandpass filtered between 5.33 kHz and 8 kHz to obtain the high band signal. The transition of this filter is between 5 and 5.33 kHz and designed to complement the low-band low-pass filter. The high- and low-band contributions are added at adder 30 to obtain the coded speech signal.

As discussed above, there are several high-band excitation coding methods.

Figure 2:
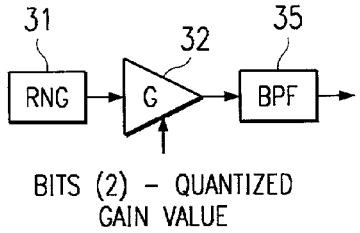
FIG. 2 is a block diagram of a random noise generator decoder.
Figure 3:
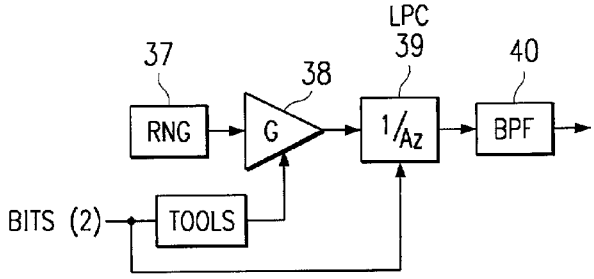
FIG. 3 is a block diagram of a gain-excited LPC decoder.
Figure 4:
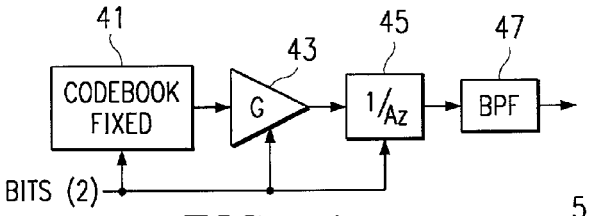
FIG. 4 is a block diagram of a gain-matched by synthesis decoder.

The simplest model is a gain-scaled random noise generator as illustrated in FIG. 2. In this case, the bits represent quantified gain value and is used for a scale factor. The random noise generator 31 output is multiplied at multiplier 32 by this scale factor and bandpass filtered at filter 35 to approximate the high-band signal. A second highband decoding is illustrated in FIG. 3 where after the noise generator 37 and gain multiplier 38 controlled by the gain value of a lookuptable accessed by the input bits, the resulting signal is passed through an LPC synthesis filter 39 (different from the one used in the low band) controlled by the input bits. The order of this filter and the size of the LPC synthesis filter codebook can be small. The intent is to apply some frequency shaping to the high-band noise. The output is filtered by bandpass filter 40.

In the gain-matched analysis by synthesis, the random noise generator is replaced by a codebook 41 containing allowable excitation vectors accessed by the input bits. The excitation vector which minimizes the error between the synthetic signal and the input, under the constraint that the output gain matches the input gain, is selected. The selected vectors are scaled or gain controlled at multiplier 43 by input bits and the resulting output is applied through LPC synthesizer filter 45 controlled by the input bits. The LPC synthesis filter 45 output is applied to bandpass filter 47. This is explained in more detail by E. Paksoy, A. McCree and V. Viswanathan in "A Variable-Rate Multimodal Speech Coder With Gain-Matched Analysis by Synthesis," *IEEE International Conference on Acoustics, Speech and Signal Processing*, April, 1997.

Figure 5:
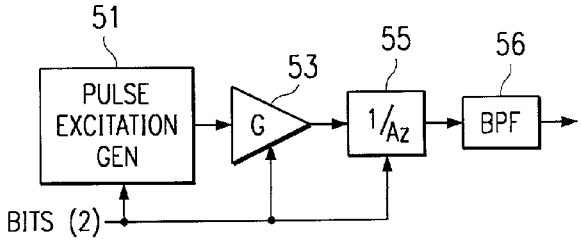
FIG. 5 is a block diagram of a pulse excitation decoder.

Another possibility is to use simple ternary pulse coding as illustrated in FIG. 5 in the high band, where the highband signal is approximated by a waveform (generated at pulse excitation generator 51) which consists of mostly zero elements, save for a few that have an amplitude of +1 or −1. This excitation waveform is gain-scaled at multiplier 53 and filtered through an LPC synthesis filter 55 and the highband band-pass filter 56 to produce the coded high-band signal. The search for the excitation and gain are done through an analysis-by-synthesis mechanism common in CELP coders. The high band coder 20 performs the complement of the decoding.

Any combination of the above techniques can also be used in such a subband coder. It should also be noted that the subband coding scheme could also be extended to more than two subbands.

We have described a subband coder where the high-band is not subsampled. The filtering and sampling rate conversion scheme is relatively simple and has the advantages of reduced complexity and reduced aliasing problems in the case of unequal subbands. We have also proposed several high-band coding methods and discussed bandpass random noise generation, LPC spectral shaping, gain-matched analysis-by-synthesis, and ternary pulse coding.

The invention claimed is:

1. A wide band signal coder comprising:

means for subdividing signals over a bandwidth into a lower subband and a higher subband signals, a downsampler for downsampling said lower subband signals, said downsampling by a factor of n/m where n and m are both integers greater than 1, a low band speech coder coupled to said downsampler for encoding said downsampled lower subband signals, and a highband coder for coding said higher subband signal without downsampling, and a combiner for combining said higher and lower subband signals.

2. The coder of claim 1, wherein said combiner includes a bandpass filter coupled to said highband coder to bandpass said higher subband signal to complement the lower subband.

3. The coder of claim 1, wherein said combiner includes upsampling said encoded lower subband signals.

4. The coder of claim 1, wherein said low band speech coder is a CELP coder.

5. The coder of claim 1, wherein said highband coder is an LPC coder.

6. The coder of claim 1, wherein said highband coder is random noise.

7. The coder of claim 1, wherein said highband coder is noise excited LPC.

8. The coder of claim 1, wherein said highband coder is gain-matched analysis by synthesis.

9. The coder of claim 1, wherein said highband coder is multi-pulse coding.

10. A speech coding system comprising:

means for subdividing signals over a bandwidth into a lower subband and a higher subband signals, a downsampler for downsampling said lower subband signals, a low band speech coder coupled to said downsampler for encoding said downsampled lower subband signals, a highband coder for coding said higher subband signal without downsampling;

a bandpass filter coupled to said highband coder to bandpass said higher subband signal to complement the lower subband;

a first decoder for decoding said encoded lower subband signals;

means for upsampling and lowpass filtering said lower subband signals to the same rate as the higher subband signals;

a second decoder for decoding said higher subband signals and bandpass filtering said higher subband signals; and an adder for summing said lower subband signals and said higher subband signals.

11. The system of claim 10, wherein said low band coder is a CELP coder.

12. The system of claim 10, wherein said highband coder is random noise and said highband decoder includes a gain-scaled random noise generator.

13. The system of claim 10, wherein said highband coder is noise excited LPC coder and said decoder includes, a gain-scaled random noise generator and the output is applied to an LPC synthesis filter.

14. The system of claim 10, wherein said highband coder includes a gain-matched by synthesis coder and the high-band decoder includes a codebook with allowable excitation vectors, a multiplier and an LPC filter.

15. The system of claim 10, wherein said coder is a multi-pulse coder and the decoder includes gain-scaling an approximation waveform that is gain-scaled and filtered by an LPC synthesis filter.

16. A wideband speech decoder system comprising:

a first decoder for decoding encoded lower subband signals;

a second highband decoder for decoding higher subband signals at a higher sampling rate than said lower subband signals;

a converter for converting said lower subband signals to the same sampling rate as the higher band signals, said converting by a factor of m/n where n and m are both integers greater than 1; and an adder for summing said lower subband signals and said higher subband signals.

17. The decoder system of claim 16, wherein said second decoder includes a gain-scaled random noise generator.

18. The decoder system of claim 16, wherein said second decoder includes a gain-scaled random noise generator and the output applied to an LPC synthesis filter.

19. The decoder system of claim 16, wherein said second decoder includes a codebook with allowable excitation vectors, a multiplier and an LPC filter.

20. The decoder system of claim 16, wherein said second decoder includes a multipulse waveform that is gain-scaled and filtered by an LPC synthesis filter.

* * * * *